US008126367B2

(12) United States Patent
Fowler

(10) Patent No.: US 8,126,367 B2
(45) Date of Patent: Feb. 28, 2012

(54) SCOROTRON APPARATUS FOR CHARGING A PHOTOCONDUCTOR

(75) Inventor: Jeffery Michael Fowler, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 748 days.

(21) Appl. No.: 12/241,830

(22) Filed: Sep. 30, 2008

(65) Prior Publication Data

US 2010/0080628 A1 Apr. 1, 2010

(51) Int. Cl.
*G03G 15/02* (2006.01)

(52) U.S. Cl. ..... 399/171

(58) Field of Classification Search ..... 399/170–173, 399/115

See application file for complete search history.

(56) References Cited

U.S. PATENT DOCUMENTS

| | | | | |
|---|---|---|---|---|
| 4,603,964 | A | 8/1986 | Swistak | |
| 5,324,942 | A | 6/1994 | Mishra et al. | |
| 6,393,237 | B1 | 5/2002 | Shindo | |
| 6,459,873 | B1 | 10/2002 | Song et al. | |
| 7,400,853 | B2 | 7/2008 | Furukawa | |
| 2006/0002740 | A1 | 1/2006 | Tanaka et al. | |
| 2007/0025755 | A1* | 2/2007 | Ishikawa et al. | 399/98 |
| 2007/0059026 | A1* | 3/2007 | Owens | 399/100 |
| 2007/0160389 | A1 | 7/2007 | Zona et al. | |
| 2007/0223961 | A1* | 9/2007 | Takamatsu | 399/111 |
| 2008/0170883 | A1 | 7/2008 | Chen et al. | |
| 2010/0061765 | A1* | 3/2010 | Fowler et al. | 399/173 |

* cited by examiner

*Primary Examiner* — David Gray
*Assistant Examiner* — Rodney Bonnette
(74) *Attorney, Agent, or Firm* — Ronald E. Prass, Jr.; Prass LLP

(57) ABSTRACT

An apparatus (100) useful in charging a photoconductor in printing is disclosed. The apparatus can include a scorotron insulator (200) having a longitudinal axis, where the scorotron insulator can have a first insulator end at one end of the longitudinal axis and a second insulator end at an opposite end of the longitudinal axis. The scorotron insulator can include at least one first spring integrated into the scorotron insulator at an insulator end and at least one second spring integrated into the scorotron insulator at an insulator end. The apparatus can include a scorotron charging grid (300) coupled to the at least one first spring at an insulator end of the scorotron insulator and coupled to another insulator end of the scorotron insulator, where the scorotron charging grid can include an electrical connector. The apparatus can include a scorotron charge member (400) including a first scorotron charge member end coupled to the second spring at an insulator end of the scorotron insulator and the scorotron charge member including a second scorotron charge member end coupled to another insulator end of the scorotron insulator. The scorotron charge member can be configured to generate an electric field.

20 Claims, 11 Drawing Sheets

SCOROTRON APPARATUS FOR CHARGING A PHOTOCONDUCTOR

RELATED APPLICATIONS

This application is related to the application entitled "XEROGRAPHIC CHARGING DEVICE HAVING PLANAR TWO PIN ARRAYS,", which is commonly assigned to the assignee of the present application, and which is incorporated herein by reference in its entirety.

BACKGROUND

Disclosed herein is a scorotron apparatus for charging a photoconductor in a printing system.

Presently, in a xerographic printing process, a scorotron is used to charge a photoreceptor so that an electrostatic latent image may be applied to the photoreceptor. The electrostatic latent image is developed to form a visible image, which is then transferred to media to generate an image on the media.

For example, a scorotron charges the photoreceptor by driving charged particles onto it. The charged particles are generated by the scorotron by creating an electric potential using a conductor having points or a conductor with a high curvature, such as a narrow diameter wire. The conductor concentrates the electric field and causes it to split the molecules in the air to distribute electrons off of the molecules in the air. The electrons are drawn by the electric field in one direction and the ions go in the other direction. A negative polarity can be used to cause the electrons and negatively charged ions to go toward the photoreceptor and the positive ions can be neutralized through a high voltage connection. Electrical potentials of hundreds or thousands of volts can be applied to drive charged particles to the photoreceptor to prepare the photoreceptor for image production. A laser or other device can then be used to apply the image to the photoreceptor and the image can be transferred to media.

A charging device such as a scorotron is necessary for charging the photoreceptor in such a process. A scorotron is relatively complex and expensive to assemble. Furthermore, a scorotron takes up precious space in a printing device. A pin array can be used in a scorotron to increase the scorotron efficiency. The pin array also makes assembly of the scorotron more complex and costly.

Thus there is a need for an improved apparatus useful in charging a photoconductor for printing.

SUMMARY

An improved apparatus useful in charging a photoconductor for printing is disclosed. The apparatus can include a scorotron insulator having a longitudinal axis, where the scorotron insulator can have a first insulator end at one end of the longitudinal axis and a second insulator end at an opposite end of the longitudinal axis. The scorotron insulator can include at least one first spring integrated into the scorotron insulator at an insulator end and at least one second spring integrated into the scorotron insulator at an insulator end. The apparatus can include a scorotron charging grid coupled to the at least one first spring at an insulator end of the scorotron insulator and coupled to another insulator end of the scorotron insulator, where the scorotron charging grid can include an electrical connector. The apparatus can include a scorotron charge member including a first scorotron charge member end coupled to the second spring at an insulator end of the scorotron insulator and the scorotron charge member including a second scorotron charge member end coupled to another insulator end of the scorotron insulator. The scorotron charge member can be configured to generate an electric field.

BRIEF DESCRIPTION OF THE DRAWINGS

In order to describe the manner in which advantages and features of the disclosure can be obtained, a more particular description of the disclosure briefly described above will be rendered by reference to specific embodiments thereof which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
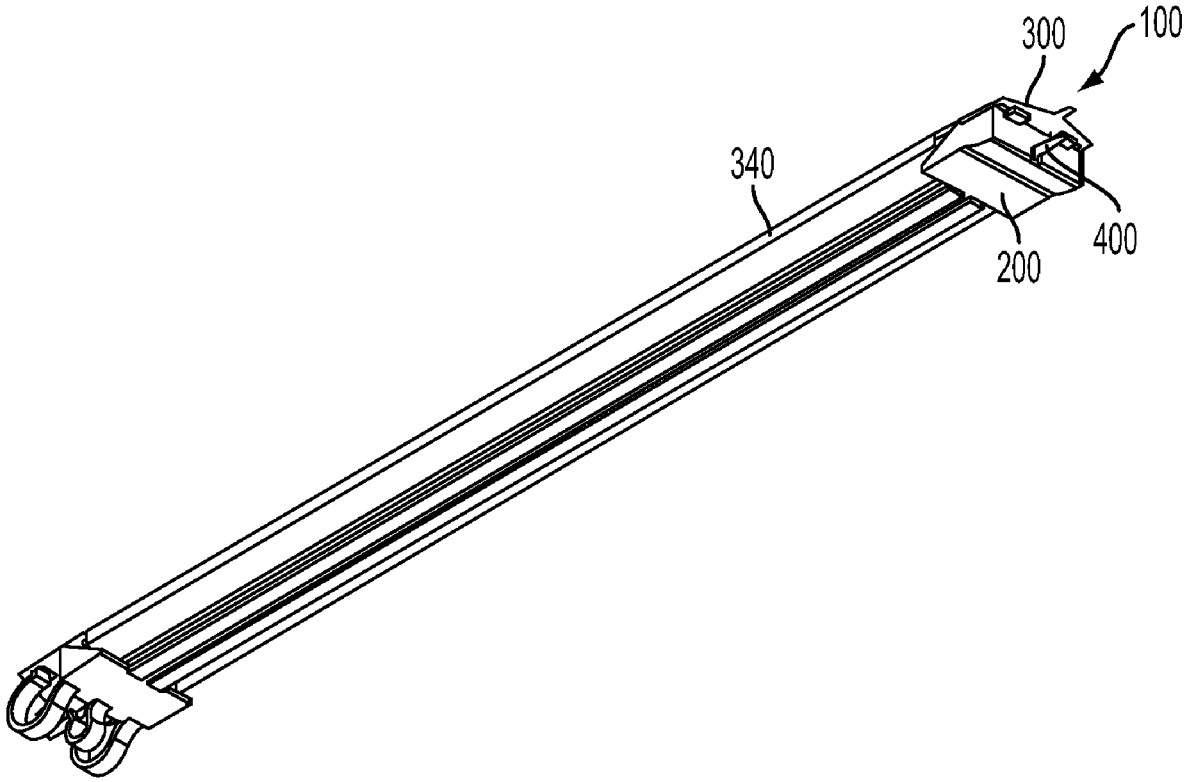
FIGS. 1 and 2 are exemplary isometric views of an apparatus.

The embodiments include an apparatus useful in charging a photoconductor in printing. The apparatus can include a scorotron insulator having a longitudinal axis, where the scorotron insulator can have a first insulator end at one end of the longitudinal axis and a second insulator end at an opposite end of the longitudinal axis. The scorotron insulator can include at least one first spring integrated into the scorotron insulator at an insulator end and at least one second spring integrated into the scorotron insulator at an insulator end. The apparatus can include a scorotron charging grid coupled to the at least one first spring at an insulator end of the scorotron insulator and coupled to another insulator end of the scorotron insulator, where the scorotron charging grid can include an electrical connector. The apparatus can include a scorotron charge member including a first scorotron charge member end coupled to the second spring at an insulator end of the scorotron insulator and the scorotron charge member including a second scorotron charge member end coupled to another insulator end of the scorotron insulator. The scorotron charge member can be configured to generate an electric field.

The embodiments further include a scorotron useful in charging a photoconductor in printing. The scorotron can include a scorotron insulator having a longitudinal axis, where the scorotron insulator can have a first insulator end at one end of the longitudinal axis and a second insulator end at an opposite end of the longitudinal axis. The scorotron insulator can include at least one first spring integrated into the scorotron insulator at an insulator end and at least one second spring integrated into the scorotron insulator at an insulator end. The scorotron can include a scorotron pin array including a first pin array end coupled to the second spring at an insulator end of the scorotron insulator and the scorotron pin array including a second pin array end coupled to another insulator end of the scorotron insulator. The scorotron pin array can be configured to generate an electric field to produce corona. The scorotron can include a scorotron charging grid coupled to the at least one first spring at an insulator end of the scorotron insulator and coupled to another insulator end of the scorotron insulator. The scorotron charging grid can include an electrical connector and can include a plurality of openings along a length of the scorotron charging grid. The scorotron charging grid can be configured to diffuse the corona from the scorotron pin array through the plurality of openings along the length of the scorotron charging grid.

The embodiments further include apparatus useful in printing. The apparatus can include a media transport configured to transport media and a photoconductor configured to generate an image on the media. The apparatus can include a scorotron insulator having a longitudinal axis. The scorotron insulator can have a first insulator end at one end of the longitudinal axis and a second insulator end at an opposite end of the longitudinal axis. The scorotron insulator can include at least one first spring integrated into the scorotron insulator at an insulator end and at least one second spring integrated into the scorotron insulator at an insulator end. The apparatus can include a scorotron charging grid coupled to the at least one first spring at an insulator end of the scorotron insulator and coupled to another insulator end of the scorotron insulator. The scorotron charging grid can include an electrical connector. The apparatus can include a scorotron pin array located on an opposite side of the scorotron charging grid from the photoconductor. The scorotron pin array can include a first pin array end coupled to the second spring at an insulator end of the scorotron insulator and the scorotron pin array can include a second pin array end coupled to another insulator end of the scorotron insulator. The scorotron pin array can be configured to generate an electric field. The scorotron charging grid and the scorotron pin array can be configured to generate a surface potential on the photoconductor.

Figure 2:
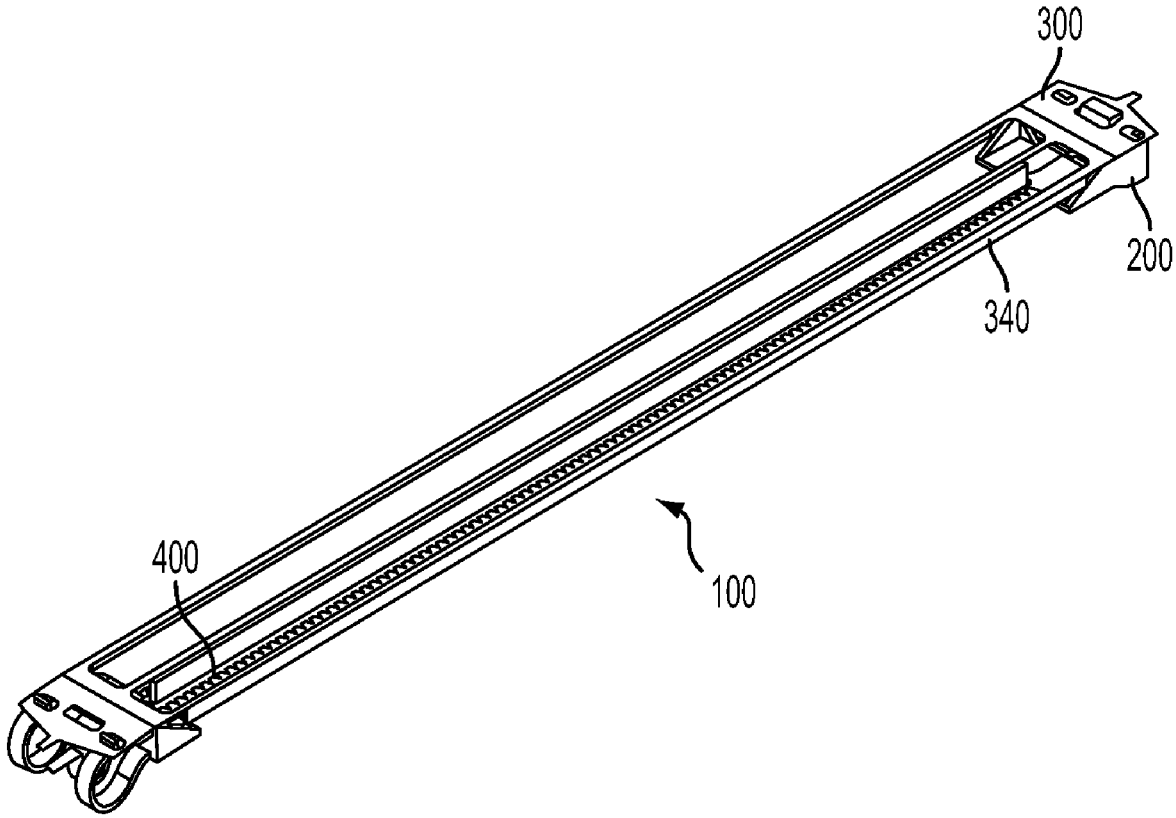
Figure 3:
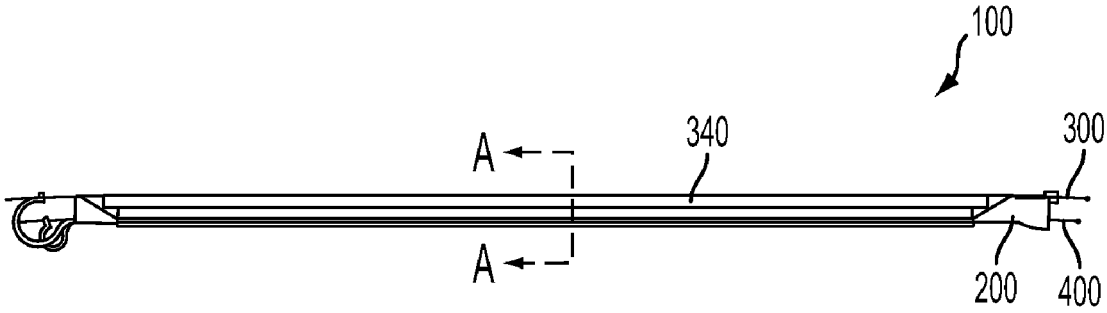
FIG. 3 is an exemplary side view of an apparatus.
Figure 4:
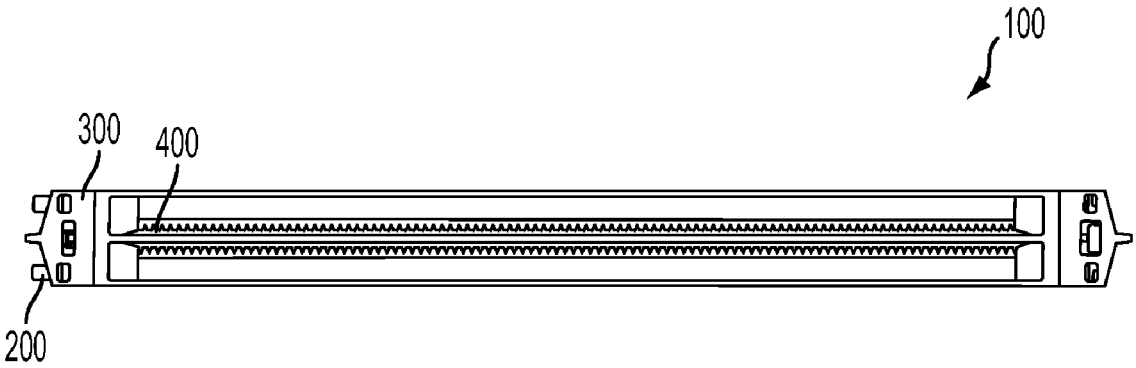
FIG. 4 is an exemplary top view of an apparatus.
Figure 5:
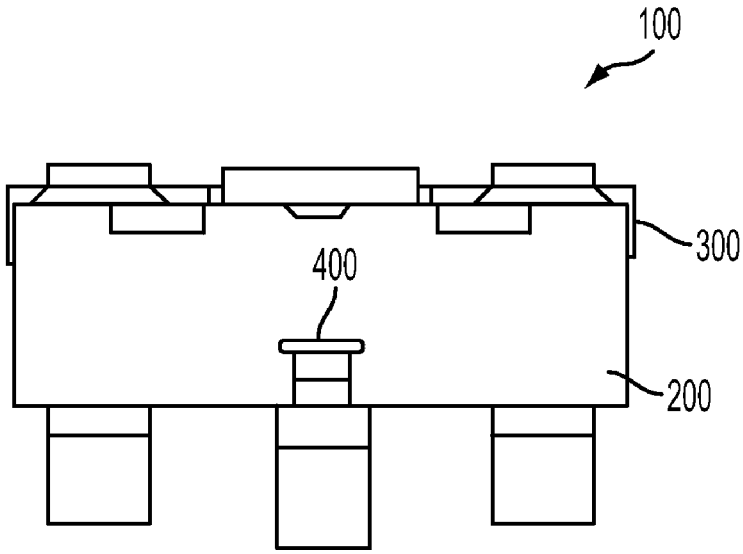
FIGS. 5 and 6 are exemplary end views of an apparatus.
Figure 6:
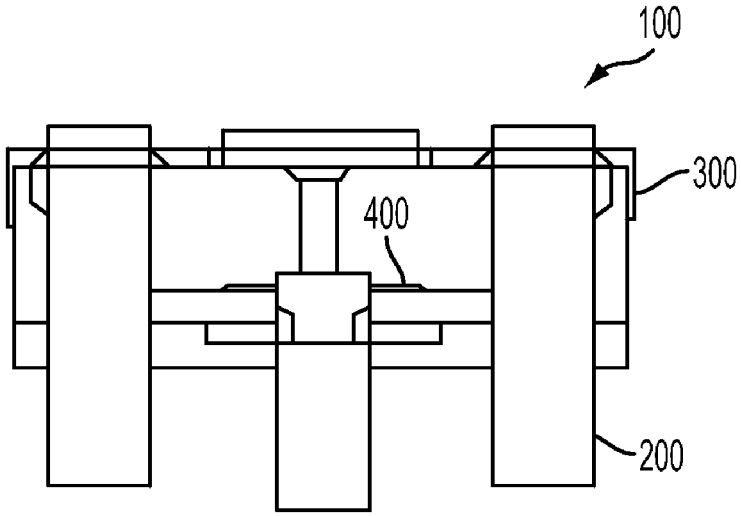
Figure 7:
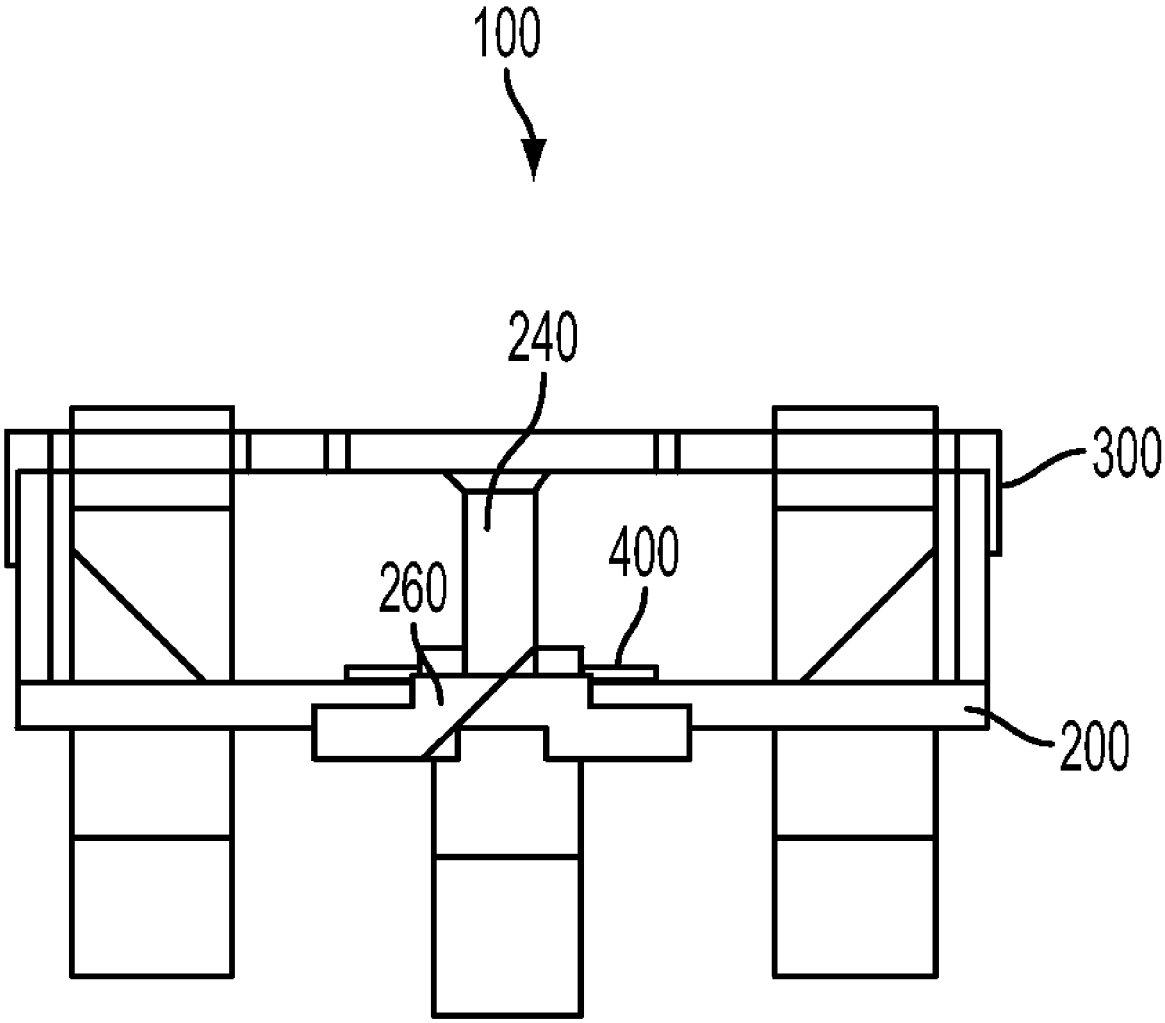
FIG. 7 is an exemplary cross-sectional view of an apparatus.

FIGS. 1 and 2 are exemplary isometric views of an apparatus 100. FIG. 3 is an exemplary side view of the apparatus 100. FIG. 4 is an exemplary top view of the apparatus 100. FIGS. 5 and 6 are exemplary end views of the apparatus 100. FIG. 7 is an exemplary cut-away view of the apparatus 100 along section A-A of FIG. 3. The apparatus 100 may be a scorotron useful for charging a photoconductor in a printing device such as a xerographic machine or other printing device that uses a photoconductor. Accordingly, as used herein, a "scorotron" is defined as any device that is configured to provide an electrical charge to a photoconductor surface in a printing device. The apparatus 100 can include a scorotron insulator 200, a scorotron charging grid 300, and a scorotron charge member 400.

Figure 8:
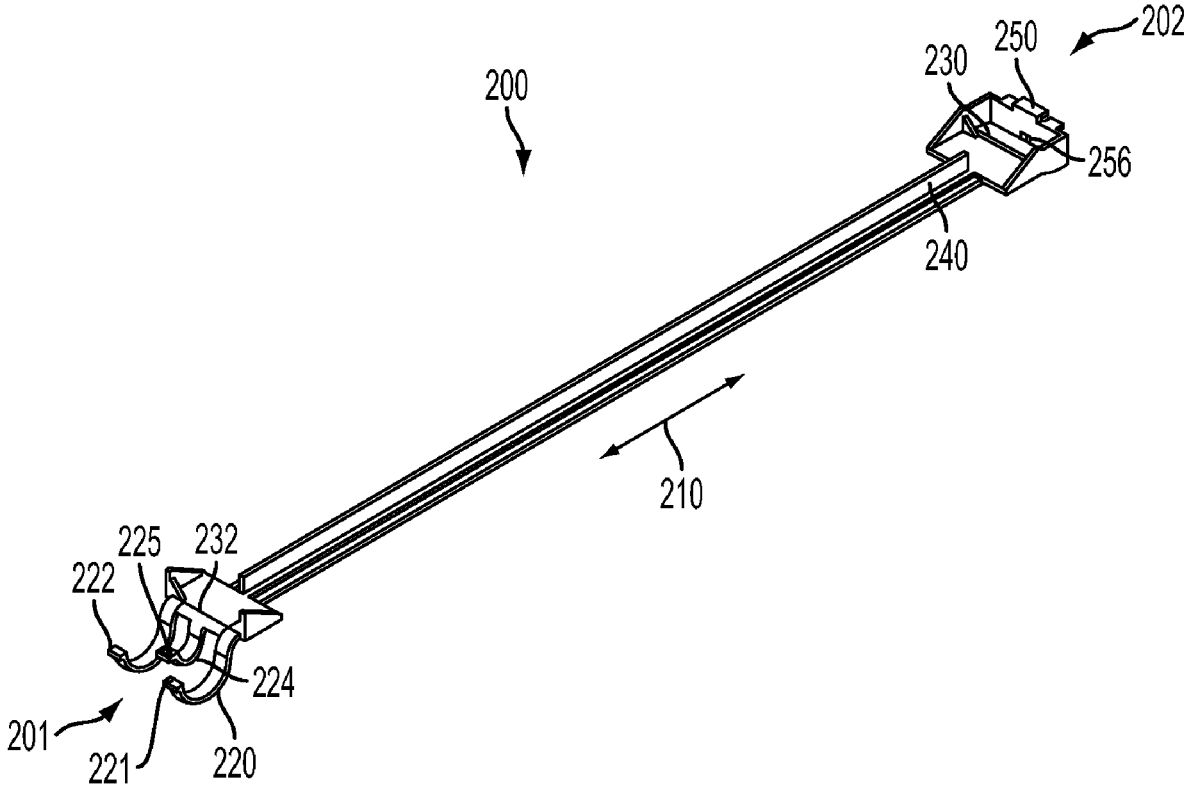
FIGS. 8 and 9 are exemplary isometric views of a scorotron insulator.
Figure 9:
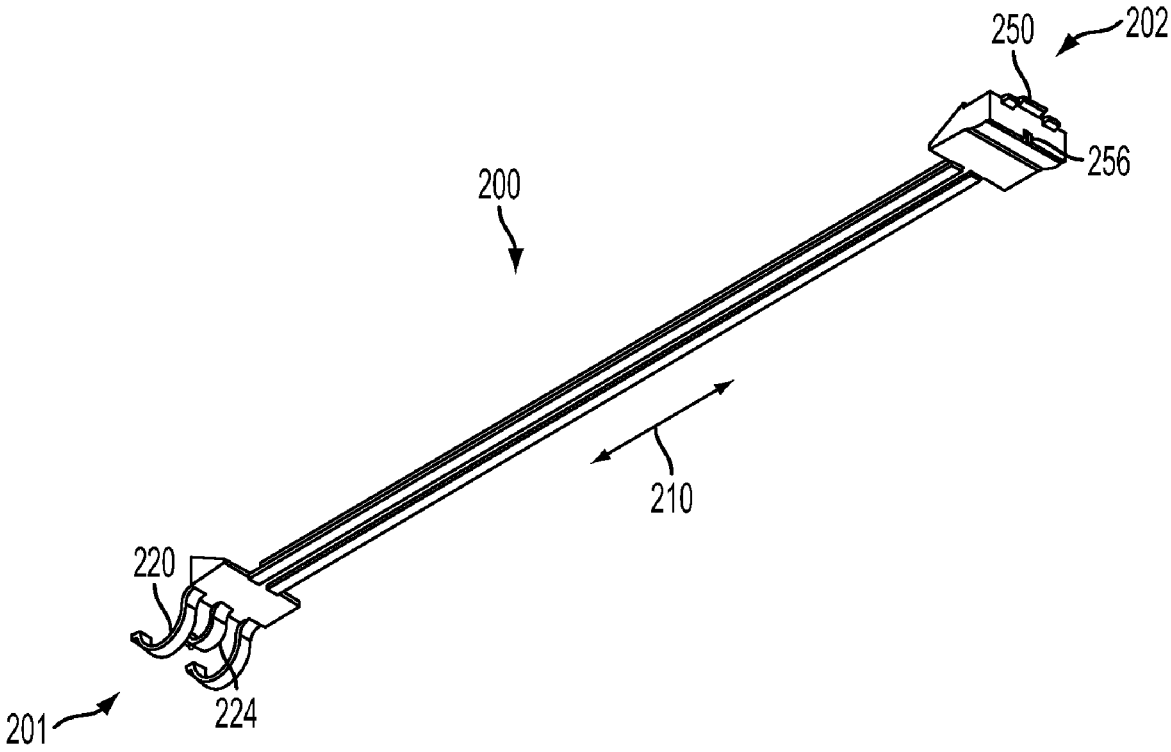
Figure 10:
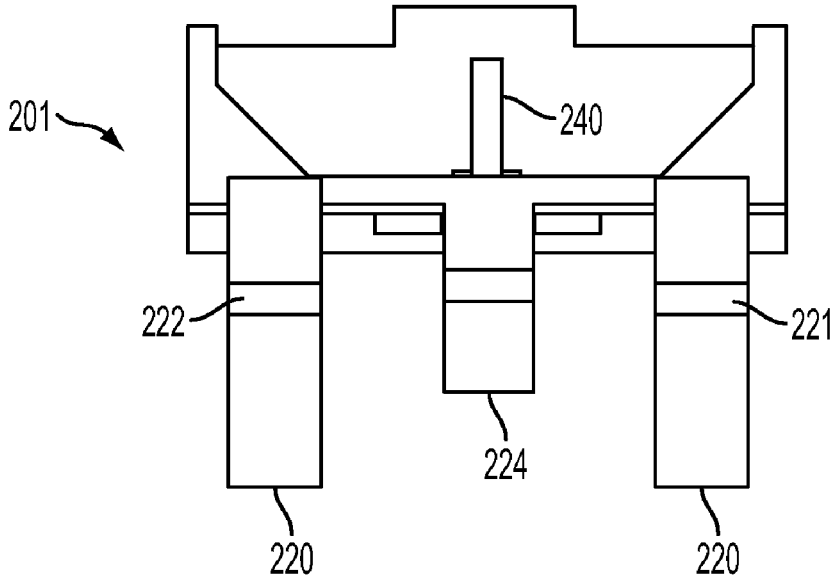
FIG. 10 is an exemplary illustration of an end of a scorotron insulator.
Figure 11:
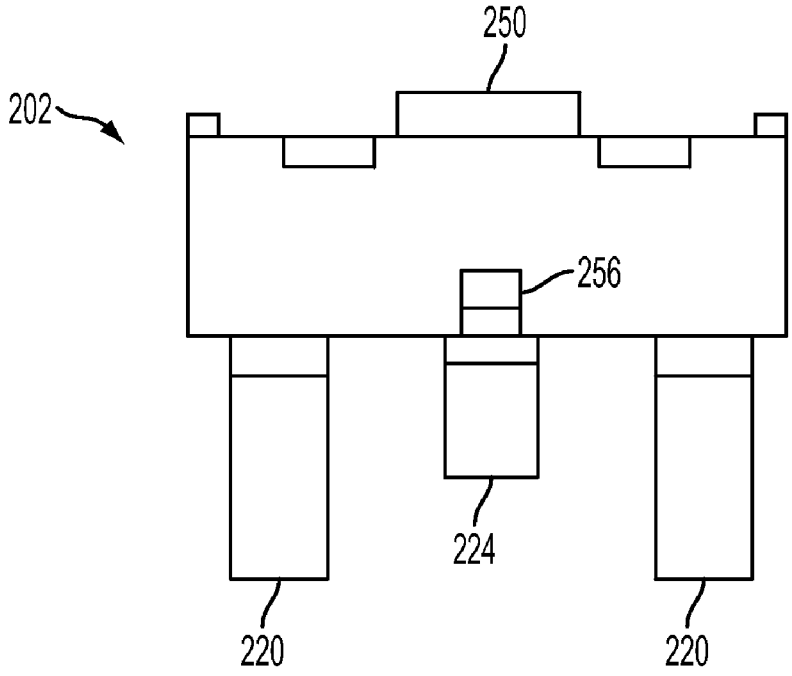
FIG. 11 is an exemplary illustration of an end of a scorotron insulator.
Figure 12:
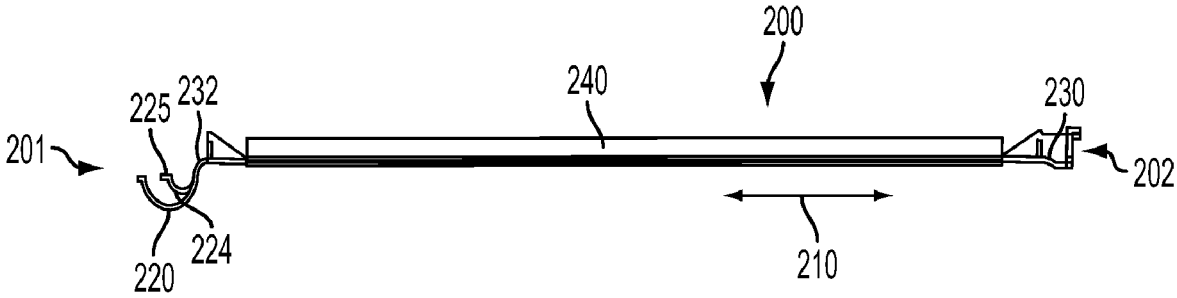
FIG. 12 is an exemplary side view of a scorotron insulator.

FIGS. 8 and 9 are exemplary isometric views of a scorotron insulator 200. FIG. 10 is an exemplary illustration of an end 201 of the scorotron insulator 200. FIG. 11 is an exemplary illustration of an end 202 of the scorotron insulator 200. FIG. 12 is an exemplary side view of the scorotron insulator 200. The scorotron insulator 200 can have a longitudinal axis 210. The scorotron insulator 200 can have a first insulator end 201 at one end of the longitudinal axis 210 and a second insulator end 202 at an opposite end of the longitudinal axis 210. The scorotron insulator 200 can include at least one first spring 220 integrated into the scorotron insulator 200 at an insulator end and at least one second spring 224 integrated into the scorotron insulator 200 at an insulator end. Also, as used herein, "integrated" is defined as being molded as a part of an element using the same material as the element. The first insulator end 201 can be an outboard insulator end and the second insulator end 202 can be an inboard insulator end and the at least one first spring 220 and the second spring 224 can be integrated into the insulator 201 at the outboard insulator end 201. An inboard insulator end can be an end configured to be coupled inside of a printing apparatus and an outboard insulator end can be an end can be an end closer to an accessible area of a printing apparatus.

Figure 13:
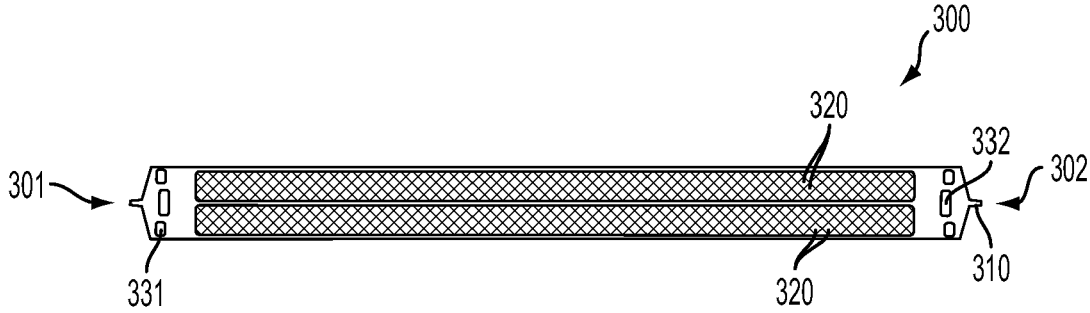
FIG. 13 is an exemplary top view of a scorotron charging grid.

FIG. 13 is an exemplary top view of a scorotron charging grid 300. The scorotron charging grid 300 can be coupled to the at least one first spring 220 at an insulator end of the scorotron insulator 200 and coupled to another insulator end of the scorotron insulator 200. The scorotron charging grid 300 can include an integrated electrical connector 310. The electrical connector 310 can be a tab configured to be coupled to a terminal in an image output terminal at the inboard insulator end 202. The scorotron charging grid 300 can be substantially symmetrical across a longitudinal axis of the scorotron insulator 200. The scorotron charging grid 300 can also be substantially symmetrical along the longitudinal axis 210 of the scorotron insulator 200. The scorotron charging grid 300 can include a plurality of openings 320 along a length of the scorotron charging grid 300. For example, the scorotron charging grid 300 can have a plurality of openings 320 in the form of a screen, a plate having a mesh pattern of holes, a series of uniform openings formed by beams or wires, or any other openings useful for a scorotron charging grid.

Figure 14:
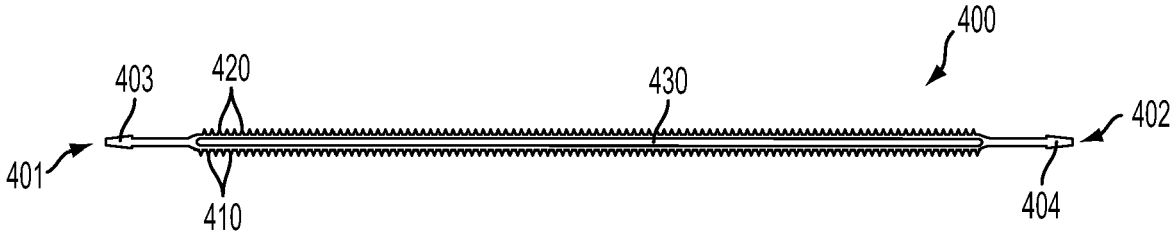
FIG. 14 is an exemplary top view of a scorotron charging member.

FIG. 14 is an exemplary top view of a scorotron charging member 400. The scorotron charge member 400 can include a first scorotron charge member end 401 coupled to the second spring 224 at an insulator end of the scorotron insulator 200 and the scorotron charge member 400 can include a second scorotron charge member end 402 coupled to another insulator end of the scorotron insulator 200. The scorotron charge member 400 can be configured to generate an electric field. The scorotron charge member 400 can be substantially symmetrical across a longitudinal axis of the scorotron insulator 200. The scorotron charge member 400 can also be substantially symmetrical along the longitudinal axis 210 of the scorotron insulator 200. The scorotron charge member 400 can be a scorotron pin array 400 configured to produce corona. For example, a corona can be due to electrical breakdown that ionizes surrounding air adjacent to the surface of an electrical conductor at high voltage. The scorotron pin array 400 can produce corona by emitting corona ions. The scorotron charge member 400 can also be a wire or other element used to produce corona in a scorotron. The scorotron pin array 400 can include pins 410 on a first side of the scorotron pin array 400 and pins 420 on a second side of the scorotron pin array 400 opposite from the first side of the scorotron pin array 400.

The scorotron pin array 400 can be configured to produce a charge and the scorotron charging grid 300 can be configured to diffuse the charge from the scorotron pin array 400 through the plurality of openings 320 along the length of the scorotron charging grid 300. For example, the scorotron charging grid 300 can include an opening pattern to control potential from the scorotron pin array 400. The charge potential of a surface of a photosensitive body can thus be controlled so as to be uniform by applying a high voltage to the scorotron pin array 400 and simultaneously applying an appropriate voltage, such as the desired voltage of the photosensitive body, to the scorotron charging grid 300.

The scorotron charging grid 300 can be electrically separated from the scorotron pin array 400 by the scorotron insulator 200. The first spring 220 of the scorotron insulator 200 can be configured to provide tension to the scorotron charging grid 300 along the scorotron insulator 200. The second spring 224 of the scorotron insulator 200 can be configured to provide tension to the scorotron pin array 400 along the scorotron insulator 200. Thus, tensioning functions can be integrated into the scorotron insulator 200. For example, springs 220 and 224 of the scorotron insulator 200 can provide tension so the parts will stay stretched out straight even under gravity, electrostatic attraction, and other forces. Providing tension on elements such as the scorotron charging grid 300 and the scorotron charge member 400 can provide for compactness of a scorotron.

The scorotron insulator 200 can include an integrated first lip 230 in proximity to one insulator end and an integrated second lip 232 in proximity to another insulator end. The scorotron pin array 400 can be coupled to the integrated first lip 230 and the integrated second lip 232. The scorotron charging grid 300 can be located a distance from the scorotron pin array 400. The distance can be affected in part according to tension of the scorotron pin array 400 over the integrated first lip 230 and the integrated second lip 232. For example, a gap between the pin array 400 and the grid 300 can be determined by tensioning the pin array over a lip 230 and 232 at each end 201 and 202. An electrical field can be determined by the difference in electrical potential between the grid 300 and the pin array 400, which is based on the voltage of each divided by a distance between the two. A smaller distance can provide a stronger electric field and a larger distance can provide a weaker electrical field. The grid 300 can be held at one voltage and the pin array 400 can have larger voltage to create a field between the two. To achieve a desired electric field, a larger voltage can be applied if pin array 400 is farther from grid 300 and a smaller voltage can be applied if the pin array 400 is closer to grid 300.

The scorotron pin array 400 can include a pin array slot 430 along a portion of a length of the scorotron pin array 400. The scorotron insulator 200 can include an integrated shield 240 extending from the scorotron insulator 200 along the longitudinal axis 210, where the integrated shield 240 can be configured to be inserted into the pin array slot 430. Also, the scorotron pin array 400 can include pins 410 on a first side and pins 420 on a second side opposite from the first side. The scorotron pin array 400 can be configured to produce corona. The integrated shield 240 can be configured to at least partially isolate corona from pins 410 on the first side of the scorotron pin array 400 from pins 420 on the second side of the scorotron pin array 400. The integrated shield 240 can also provide support and stiffness against tension incurred on the scorotron insulator 200 from the scorotron charging grid 300 and the scorotron pin array 400.

The at least one first spring 220 can be integrated into the scorotron insulator 200 at the first insulator end 201 and the second spring 224 can be integrated into the scorotron insulator 200 at the first insulator end 201. The scorotron charging grid 300 can be coupled to the at least one first spring 201 at the first insulator end 201 and the scorotron charging grid 300 can be coupled to the second insulator end 202. The first pin array end 401 can be coupled to the second spring 224 at the first insulator end 201 and the second pin array end 402 can be coupled to the second insulator end 202. The springs 220 and 224 may be located at the same end as each other or at opposite ends from each other on the scorotron insulator 200.

The second insulator end 202 can include a second insulator end tab 250 and the least one first spring 220 can includes a first spring hook 221. The scorotron charging grid 300 can include a first scorotron charging grid end 301 and the scorotron charging grid 300 can include a second scorotron charging grid end 302 at an opposite end of the scorotron charging grid 300 from the first scorotron charging grid end 301. The first scorotron charging grid end 301 can include a first scorotron charging grid aperture 331 coupled to the first spring hook 221 and the second scorotron charging grid end 302 can include a second scorotron charging grid aperture 332 coupled to the second insulator end tab 250. The first scorotron charging grid end 301 can be substantially symmetrical with the second scorotron charging grid end 302.

The second spring 224 can include a second spring aperture 225. The first pin array end 401 can include a first tab 403 coupled to the second spring aperture 225. The first pin array end 401 can be substantially symmetrical with the second pin array end 402. For example, the second insulator end 202 can include a second insulator end aperture 256, such as a hole, and the second pin array end 402 can include a second tab 404 that can be coupled to the second insulator end aperture 256. The second tab 404 can also act as an integrated electrical connector.

The apparatus 100 can be mounted and located relative to a photoconductor (not shown). The scorotron charging grid 300 can be located between the scorotron pin array 400 and the photoconductor. The scorotron charging grid 300 and the scorotron pin array 400 can be configured to generate a surface potential on the photoconductor. For example, the scorotron charging grid 300 and the scorotron pin array 400 can generate a surface potential on the photoconductor by charging the surface of the photoconductor. Other elements may be incorporated into the apparatus 100. For example, cleaning elements can be incorporated into the apparatus 100 in addition to the scorotron insulator 200, the scorotron charging grid 300, and the scorotron pin array 400. A cleaning function can be more of a maintenance function, whereas the scorotron insulator 200, the scorotron charging grid 300, and the scorotron pin array 400 can provide the primary function of a scorotron.

According to a related embodiment, the scorotron charging member 400 can be a unified dual pin array 400. Tensioning of the scorotron charging member 400 can be integrated into the insulator 200. Electrical plugs can be integrated into the pin array 400 and the grid 300. Thus, all of the core functionality of a scorotron, excluding cleaning and other ancillary functions, may be captured with 3 parts. This can provide assembly benefits, not the least of which is reduced cost. Assembly can be further streamlined if the pin array 400 and the grid 300 are made symmetrical, as in the illustrative examples presented herein. Further, a unified dual pin array 400 can provide for a lower profile for greater flexibility in the layout of higher-level systems.

Further variations can incorporate other considerations. One consideration can be airflow where the illustrative design is very open and a wide range of airflow options may be applied. Another consideration can be mounting and locating the scorotron 100 relative to a photoconductive drum. Another consideration can be the characteristics of the living springs, such as springs 220 and 224, where several geometric parameters can allow independent design of the assembled position, assembled force, and spring constants for the types of spring where these or other choices can ensure that the grid 300 and pin array 400 tension is balanced from one side to the other. For example spring constants, in other words, the sensitivity of the force to the position, can be adjusted by changing the thickness, the radius, and/or the location of the springs 220 and 224. The material of the springs 220 and 224 can be the same as the all of the insulator 200. A bending stiffness can be achieved based on the insulator material, the spring geometric parameters, and the geometric parameters of the main cross section so tension can be maintained on the grid 300 and pin array 400 without excessive deformation of the main body of the insulator 200. Stiffness of the living springs 220 and 224 can be determined so the springs 220 and 224 apply the proper amount of tension to the grid 300 and the pin array 400.

Another consideration can be establishing a high electrical impedance between the pin array 400 and the grid 300. Another consideration can be the choice of material compatible with the living spring 220 and 224 design. For example, polypropylene can offer high resistivity and good performance under large deflection. The material can be an electrical insulator to a sufficient degree. Another consideration can be bending stiffness where appropriate design of the cross-section and mounting strategy could avoid any need for an insert. The insulator 200 can be able to tolerate at least a few cycles of deformation without damage and can be able to take any applied strains. The insulator 200 can be simultaneously stiff enough and flexible enough, which can be controlled by the geometric properties of the areas that need the different properties. For example, the flexible areas can be thinner. Also, the stiffer areas can have a higher bending moment of inertia, which can mean that at least in some directions, the areas can be thicker. As a further example, a T-beam 260 can be used to create a higher bending moment of inertia in desired directions. The T-beam 260 can include the vertical shield 240.

Another consideration can be uniformity, such as whether the insulator 200 should back the pin array 400 along its full length. Also, the insulator 200 in the illustrative example design may be molded without slides, so tooling cost can also be reduced. All of the considerations above can be implemented using a mold without slides.

As a further example, the grid 300 can fit over a tab 250 on the inboard end 202 of the insulator 200 and over two hooks 221 and 222 on the living spring features 220 of the insulator 200. The grid 300 shown can include side shields 340 along its length. The grid 300 can directly contact a terminal in an image output terminal via an integrated tab 310 on its inboard end 302. The grid 300 can be symmetrical and can include extra holes corresponding to the holes 331 and 332 that can be used for manipulating the grid 300 for assembly.

The unified dual pin array can have an integrated tab 403 and 404 on each end 401 and 402, respectively. One tab 403 can hook into a hole 225 in the living spring feature 224 on the outboard end 201 of the insulator 200 and the other tab 404 can hook into a hole 256 on the inboard end 202. The inboard tab 404 can extend beyond the insulator 200 for direct contact with an image output terminal. The gap between the pin array 400 and the grid 300 can be determined by tensioning the pin array 400 over a lip 230 and 232 on each end of the insulator 200. In the illustrative example design, the insulator 200 can support the pin array 400 along its entire length, but an alternative embodiment design may only partially support the pin array 400, such as at the pin array ends 401 and 402. A vertical shield 240 can extend through a slot 430 in the pin array 400 in order to partially isolate the corona from each row of pins 410 and 420, respectively. The presence or design of the shield 240 may be different in alternate embodiments.

The springs 220 and 224 and holes 225 and 256 can be designed to allow for a mold without slides for the insulator 200. The grid 300 and the pin array 400 can be respectively symmetrical. The first row of pins 410 can be staggered by half of a pitch with the second row of pins 420 to improve uniformity. Integrating the two rows 410 and 420 into the same part can simplify its implementation.

According to a related embodiment, the apparatus 100 can be a scorotron including a scorotron insulator 200 having a longitudinal axis 210. The scorotron insulator 200 can have a first insulator end 201 at one end of the longitudinal axis 210 and a second insulator end 202 at an opposite end 202 of the longitudinal axis 210. The scorotron insulator 200 can include at least one first spring 220 integrated into the scorotron insulator 200 at an insulator end and at least one second spring 224 integrated into the scorotron insulator 200 at an insulator end. The apparatus 100 can include a scorotron pin array 400 that can include a first pin array end 401 coupled to the second spring 224 at an insulator end of the scorotron insulator 200 and the scorotron pin array 400 can include a second pin array end 402 coupled to another insulator end of the scorotron insulator 200. The scorotron pin array 400 can be configured to generate an electric field to produce corona. The apparatus 100 can include a scorotron charging grid 300 coupled to the at least one first spring 220 at an insulator end of the scorotron insulator 200 and coupled to another insulator end of the scorotron insulator 200. The scorotron charging grid 300 can include an electrical connector 310. The scorotron charging grid 300 can include plurality of openings 320 along a length of the scorotron charging grid 300. The scorotron charging grid 300 can be configured to diffuse the corona from the scorotron pin array 400 through the plurality of openings 320 along the length of the scorotron charging grid 300.

The at least one first spring 220 can be configured to provide tension to the scorotron charging grid 300 along the scorotron insulator 200. The at least one second spring 224 can be configured to provide tension to the scorotron pin array 400 along the scorotron insulator 200. The scorotron insulator 200 can include an integrated first lip 230 in proximity to one insulator end and an integrated second lip 232 in proximity to another insulator end. The scorotron pin array 400 can be coupled to the integrated first lip 230 and the integrated second lip 232 to provide tension to the scorotron pin array 400. The scorotron pin array 400 can include a pin array slot 430 along a portion of a length of the scorotron pin array 400. The scorotron insulator 200 can include an integrated shield 240 extending from the scorotron insulator 200 along the longitudinal axis 210. The integrated shield 240 can be configured to be inserted into the pin array slot 230.

Figure 15:
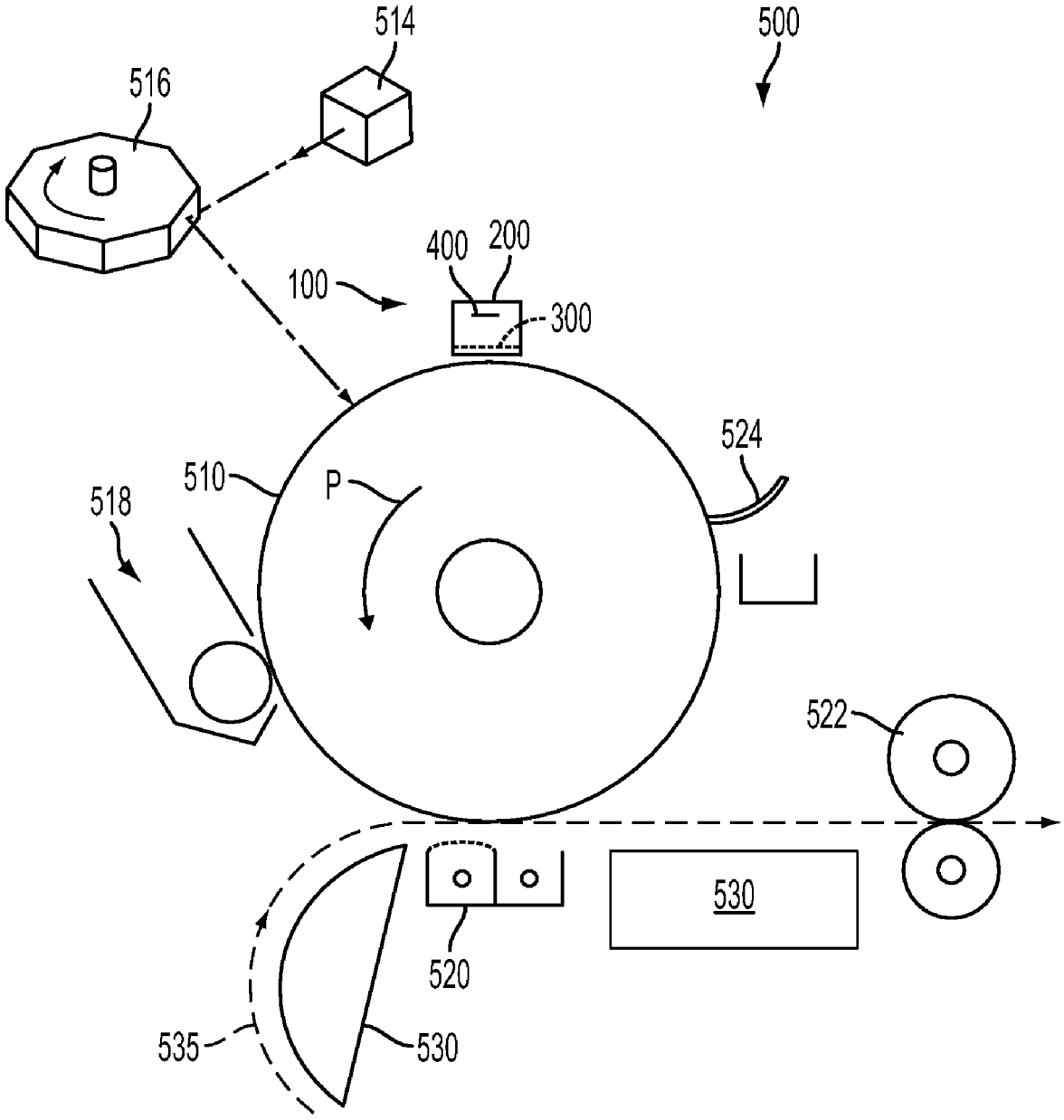
FIG. 15 is an exemplary illustration of a printing apparatus.

FIG. 15 is an exemplary illustration of a printing apparatus 500. The printing apparatus 500 may be a printer, a multifunction media device, a xerographic machine, a laser printer, or any other device that uses a scorotron to charge a photoreceptor to generate an image on media. The printing apparatus 500 can include a media transport 530, a photoconductor or photoreceptor 510, and the apparatus 100 from the previous figures. The media transport 530 can transport media 535. The photoreceptor 510 can be a belt or drum and can include a charge-retentive surface for forming electrostatic images thereon. The photoreceptor 510 can rotate in the process direction P and can generate an image on the media 535.

The apparatus 100 can be a scorotron that can include a scorotron insulator 200 having a longitudinal axis 210. The scorotron insulator 200 can have a first insulator end 201 at one end of the longitudinal axis 210 and a second insulator end 202 at an opposite end of the longitudinal axis 210. The scorotron insulator 200 can include at least one first spring 220 integrated into the scorotron insulator 200 at an insulator end and at least one second spring 224 integrated into the scorotron insulator 200 at an insulator end. The apparatus 100 can include a scorotron charging grid 300 coupled to the at least one first spring 220 at an insulator end of the scorotron insulator 200 and coupled to another insulator end of the scorotron insulator 200. The at least one first spring 220 can be configured to provide tension to the scorotron charging grid 300 along the scorotron insulator 200. The scorotron charging grid 300 can include an electrical connector 310. The apparatus 100 can include a scorotron pin array 400 located on an opposite side of the scorotron charging grid 300 from the photoconductor 510. The scorotron pin array 400 can include a first pin array end 401 coupled to the second spring 224 at an insulator end of the scorotron insulator 200 and the scorotron pin array 400 can include a second pin array end 402 coupled to another insulator end of the scorotron insulator 200. The at least one second spring 224 can be configured to provide tension to the scorotron pin array 400 along the scorotron insulator 200. The scorotron pin array 400 can be configured to generate an electric field. The scorotron charging grid 300 and the scorotron pin array 400 can be configured to generate a surface potential on the photoconductor 510.

In a more detailed operation, the apparatus 100 can charge the photoreceptor 510 surface by imparting an electrostatic charge on the surface of the photoreceptor 510 as the photoreceptor 510 rotates. A raster output scanner or other relevant device can discharge selected portions of the photoreceptor 510 in a configuration corresponding to the desired image to be printed. For example, a raster output scanner can include a laser source 514 and a rotatable mirror 516 which can act together to discharge certain areas of the surface of photoreceptor 510 according to a desired image to be printed. Other elements can be used instead of a laser source 514 to selectively discharge the charge-retentive surface, such as an LED bar, a light-lens system, or other elements that can discharge a charge-retentive surface. The laser source 514 can be modulated in accordance with digital image data fed into it, and the rotating mirror 516 can cause the modulated beam from laser source 514 to move in a fast-scan direction perpendicular to the process direction P of the photoreceptor 510.

After certain areas of the photoreceptor 510 are discharged by the laser source 514, a developer unit 518 can develop the remaining charged areas, which can cause a supply of dry toner to contact or otherwise approach the surface of photoreceptor 510. A transfer station 520 can then cause the toner adhering to the photoreceptor 510 to be electrically transferred to media 535, such as paper, plastic, or other media, to form the image thereon. The media with the toner image thereon can then be passed through a fuser 522, which can cause the toner to melt, or fuse, into the media to create the permanent image. A cleaning blade 524 or equivalent device can remove any residual toner remaining on the photoreceptor 510.

Embodiments can provide for a scorotron that can use only three parts to satisfy the scorotron functionality by integrating tensioning functions into the scorotron insulator 200, and integrating electrical plugs into a scorotron pin array 400 and the scorotron charging grid 300. The insulating material can also be used as a spring. This can simplify assembly and reduce cost. The scorotron pin array 400 can also permit a lower profile for greater flexibility in the layout of higher-level systems.

Embodiments may preferably be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the preferred embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

I claim:

1. An apparatus useful in charging a photoconductor in printing, the apparatus comprising:

a scorotron insulator having a longitudinal axis, the scorotron insulator having a first insulator end at one end of the longitudinal axis and a second insulator end at an opposite end of the longitudinal axis, the scorotron insulator including at least one first spring integrated into the scorotron insulator at an insulator end and at least one second spring integrated into the scorotron insulator at an insulator end;

a scorotron charging grid coupled to the at least one first spring at an insulator end of the scorotron insulator and coupled to another insulator end of the scorotron insulator, the scorotron charging grid including an electrical connector; and a scorotron charge member including a first scorotron charge member end coupled to the second spring at an insulator end of the scorotron insulator and the scorotron charge member including a second scorotron charge member end coupled to another insulator end of the scorotron insulator, the scorotron charge member configured to generate an electric field, wherein the first spring is integrated into the scorotron insulator by being molded as a part of the scorotron insulator using the same material as the scorotron insulator, and wherein the at least one second spring is integrated into the scorotron insulator by being molded as a part of the scorotron insulator using the same material as the scorotron insulator.

2. The apparatus according to claim 1, wherein the scorotron charge member comprises a scorotron pin array configured to produce corona.

3. The apparatus according to claim 2, wherein the scorotron pin array includes pins on a first side of the scorotron pin array and pins on a second side of the scorotron pin array opposite from the first side of the scorotron pin array.

4. The apparatus according to claim 2, wherein the scorotron charging grid includes a plurality of openings along a length of the scorotron charging grid.

5. The apparatus according to claim 4, wherein the scorotron pin array is configured to produce a charge, and wherein the scorotron charging grid is configured to diffuse the charge from the scorotron pin array through the plurality of openings along the length of the scorotron charging grid.

6. The apparatus according to claim 2, wherein the scorotron charging grid is electrically separated from the scorotron pin array by the scorotron insulator.

7. The apparatus according to claim 2, wherein the first spring is configured to provide tension to the scorotron charging grid along the scorotron insulator, and wherein the second spring is configured to provide tension to the scorotron pin array along the scorotron insulator.

8. The apparatus according to claim 2, wherein the scorotron insulator includes an integrated first lip in proximity to one insulator end and an integrated second lip in proximity to another insulator end, wherein scorotron pin array is coupled to the integrated first lip and the integrated second lip, wherein the scorotron charging grid is located a distance from the scorotron pin array, and wherein the distance is affected in part according to tension of the scorotron pin array over the integrated first lip and the integrated second lip.

9. The apparatus according to claim 2, wherein the scorotron pin array includes a pin array slot along a portion of a length of the scorotron pin array, and wherein the scorotron insulator includes an integrated shield extending from the scorotron insulator along the longitudinal axis, the integrated shield configured to be inserted into the pin array slot.

10. The apparatus according to claim 9, wherein the scorotron pin array includes pins on a first side and pins on a second side opposite from the first side, wherein the scorotron pin array is configured to produce corona, and wherein the integrated shield is configured to at least partially isolate corona from pins on the first side of the scorotron pin array from pins on the second side of the scorotron pin array.

11. The apparatus according to claim 2, wherein the at least one first spring is integrated into the scorotron insulator at the first insulator end and the second spring is integrated into the scorotron insulator at the first insulator end;

wherein the scorotron charging grid is coupled to the at least one first spring at the first insulator end and the scorotron charging grid is coupled to the second insulator end, and wherein the first pin array end is coupled to the second spring at the first insulator end and the second pin array end is coupled to the second insulator end.

12. The apparatus according to claim 2, wherein the second insulator end includes a second insulator end tab and the least one first spring includes a first spring hook, wherein the scorotron charging grid includes a first scorotron charging grid end and the scorotron charging grid includes a second scorotron charging grid end at an opposite end of the scorotron charging grid from the first scorotron charging grid end, and wherein the first scorotron charging grid end includes a first scorotron charging grid aperture coupled to the first spring hook and the second scorotron charging grid end includes a second scorotron charging grid aperture coupled to the second insulator end tab.

13. The apparatus according to claim 2, wherein the second spring includes a second spring aperture, and wherein the first pin array end includes a first tab coupled to the second spring aperture.

14. The apparatus according to claim 2, wherein the apparatus is mounted and located relative to a photoconductor, wherein the scorotron charging grid is located between the scorotron pin array and the photoconductor, and wherein the scorotron charging grid and the scorotron pin array are configured to generate a surface potential on the photoconductor.

15. A scorotron useful in charging a photoconductor in printing, the scorotron comprising:

a scorotron insulator having a longitudinal axis, the scorotron insulator having a first insulator end at one end of the longitudinal axis and a second insulator end at an opposite end of the longitudinal axis, the scorotron insulator including at least one first spring integrated into the scorotron insulator at an insulator end and at least one second spring integrated into the scorotron insulator at an insulator end;

a scorotron pin array including a first pin array end coupled to the second spring at an insulator end of the scorotron insulator and the scorotron pin array including a second pin array end coupled to another insulator end of the scorotron insulator, the scorotron pin array configured to generate an electric field to produce corona; and a scorotron charging grid coupled to the at least one first spring at an insulator end of the scorotron insulator and coupled to another insulator end of the scorotron insulator, the scorotron charging grid including an electrical connector, the scorotron charging grid including a plurality of openings along a length of the scorotron charging grid, the scorotron charging grid configured to diffuse the corona from the scorotron pin array through the plurality of openings along the length of the scorotron charging grid, wherein the first spring is integrated into the scorotron insulator by being molded as a part of the scorotron insulator using the same material as the scorotron insulator, and wherein the at least one second spring is integrated into the scorotron insulator by being molded as a part of the scorotron insulator using the same material as the scorotron insulator.

16. The scorotron according to claim 15, wherein the at least one first spring is configured to provide tension to the scorotron charging grid along the scorotron insulator, and wherein the at least one second spring is configured to provide tension to the scorotron pin array along the scorotron insulator.

17. The scorotron according to claim 15, wherein the scorotron insulator includes an integrated first lip in proximity to one insulator end and an integrated second lip in proximity to another insulator end, wherein the scorotron pin array is coupled to the integrated first lip and the integrated second lip to provide tension to the scorotron pin array.

18. The scorotron according to claim 15, wherein the scorotron pin array includes a pin array slot along a portion of a length of the scorotron pin array, and wherein the scorotron insulator includes an integrated shield extending from the scorotron insulator along the longitudinal axis, the integrated shield configured to be inserted into the pin array slot.

19. An apparatus useful in printing, the apparatus comprising:

a media transport configured to transport media;

a photoconductor configured to generate an image on the media;

a scorotron insulator having a longitudinal axis, the scorotron insulator having a first insulator end at one end of the longitudinal axis and a second insulator end at an opposite end of the longitudinal axis, the scorotron insulator including at least one first spring integrated into the scorotron insulator at an insulator end and at least one second spring integrated into the scorotron insulator at an insulator end;

a scorotron charging grid coupled to the at least one first spring at an insulator end of the scorotron insulator and coupled to another insulator end of the scorotron insulator, the scorotron charging grid including an electrical connector; and a scorotron pin array located on an opposite side of the scorotron charging grid from the photoconductor, the scorotron pin array including a first pin array end coupled to the second spring at an insulator end of the scorotron insulator and the scorotron pin array including a second pin array end coupled to another insulator end of the scorotron insulator, the scorotron pin array configured to generate an electric field, wherein the scorotron charging grid and the scorotron pin array are configured to generate a surface potential on the photoconductor, wherein the first spring is integrated into the scorotron insulator by being molded as a part of the scorotron insulator using the same material as the scorotron insulator, and wherein the at least one second spring is integrated into the scorotron insulator by being molded as a part of the scorotron insulator using the same material as the scorotron insulator.

20. The apparatus according to claim 19, wherein the at least one first spring is configured to provide tension to the scorotron charging grid along the scorotron insulator, and wherein the at least one second spring is configured to provide tension to the scorotron pin array along the scorotron insulator.

* * * * *

UNITED STATES PATENT AND TRADEMARK OFFICE

CERTIFICATE OF CORRECTION

PATENT NO. : 8,126,367 B2
APPLICATION NO. : 12/241830
DATED : February 28, 2012
INVENTOR(S) : Jeffrey Michael Fowler It is certified that error appears in the above-identified patent and that said Letters Patent is hereby corrected as shown below:

Title Page, Item (75) Inventor: "Jeffery" should read --Jeffrey--

Signed and Sealed this
Sixth Day of November, 2012

David J. Kappos

David J. Kappos
*Director of the United States Patent and Trademark Office*